United States Patent [19]

Doughty

[11] Patent Number: 4,773,650

[45] Date of Patent: Sep. 27, 1988

[54] METHOD OF PLAYING A FOOTBALL BOARD GAME

[76] Inventor: Donald D. Doughty, P.O. Box 247, Epps, La. 71237

[21] Appl. No.: 781,324

[22] Filed: Sep. 30, 1985

Related U.S. Application Data

[62] Division of Ser. No. 608,715, May 10, 1984, abandoned.

[51] Int. Cl.[4] ..... A63F 3/00

[52] U.S. Cl. ..... 273/247

[58] Field of Search ..... 273/298, 247, 94

[56] References Cited

U.S. PATENT DOCUMENTS

| | | | |
|---|---|---|---|
| 1,992,475 | 2/1935 | De Hart | 273/247 |
| 2,060,973 | 11/1936 | Brown et al. | 273/247 |
| 2,064,466 | 12/1936 | Downey | 273/298 |
| 3,423,090 | 1/1969 | Pfund | 273/247 |
| 4,289,315 | 9/1981 | O'Barr | 273/298 |

FOREIGN PATENT DOCUMENTS

| | | | |
|---|---|---|---|
| 10811 | of 1913 | United Kingdom | 273/298 |

*Primary Examiner*—Richard C. Pinkham
*Assistant Examiner*—Benjamin Layno
*Attorney, Agent, or Firm*—Dennis T. Griggs

[57] ABSTRACT

A game-board representing a simulated football field, on which the placement and movement of a ball marker representing a football is determined by the selection and interpretation of a message on cards drawn from one of the five decks of cards. Each deck of cards is provided with an active decks area and an adjacent used deck area. The decks of cards are initially placed on their corresponding active deck areas. The selection of the deck from which a card is chosen is made with reference to the play according to the rules of football. The players draw for the privilege of choosing whether to kick-off or receive and the players draw cards on offense until they lose possession of the ball. The opponent then takes possession and draws cards in turn until he loses possession of the ball. After each card is drawn and used it is placed on its corresponding used deck area. The game is over when all the down deck cards have been used. Players visually compare the relative heights of the active and used down decks. This provides a visual cue instantly and continually showing when the game is nearing its end. A half-time card inserted at the beginning of the game in approximately the middle of the down card deck determines the end of the first half.

2 Claims, 3 Drawing Sheets

METHOD OF PLAYING A FOOTBALL BOARD GAME

This is a divisional of co-pending application Ser. No. 608,715 filed on May 10, 1984 and now abandoned.

BACKGROUND OF THE INVENTION

1. Field of the Invention

The invention relates to board games and more particularly to a board game simulating a professional football game wherein the results of a play are obtained from a card taken from one of five stacks each containing cards in relation to the frequency of actual events taking place in an average real game.

2. Description of the Prior Art

There are a number of board games on the market which utilize a play selection method which attempts to simulate the happenings that typically are experienced in a real football game. Most of the available board games in this subject matter combine some degree of skill in play selection with the element of chance. The element of chance is sometimes added by means of a "spinner" which is used to select a random number within a certain range of numbers which by reference to a chart, and in combination with a selection of a particular chart or a particular play among a group of plays on such chart, produces a particular result. Usually the ball marker and a yardage marker are used on a simulated playing field.

In some games one player draws a card and the other player draws a card which produces a particular result when the two cards are combined. Still other games have a limited choice of plays for the offense such as end run, long pass, off tackle, etc. and the defensive player has a means of selecting a particular defense with the result being determined by a combination of the offensive and defensive play. A reading is taken from a change control device with the result being reduced to a particular block of numbers which when read produce a single result.

This type of game required that the players maintain secrecy by shielding their selection from the opposing player. Sometimes additional factors are added such as relating the results to the side or position of the ball marker on the simulated playing field.

OBJECT OF THE INVENTION

The principal object of the invention is to provide a football game which incorporates most of the events which typically occur in an actual game such as penalties, sacks, fumbles, interceptions and so forth and does so with a frequency which simulates the frequency of the events of an actual football game.

Another object of the invention is to provide a fast paced football game which can be enjoyed by players of different skill levels.

Another object of the invention is to provide each player with their own goal to defend and to eliminate unnecessary quarters which have no bearing on the outcome of the game or the play.

A related object of the invention is to provide a simplified football board game in which the progress of the game is easily discernable and which includes a visual cue to indicate progress of the game.

Another object of the invention is to provide a game that moves fast and is fun to play because it minimizes the number and complexity of operations required by the players which makes the game more enjoyable for children as well as adults, but which retains the uncertainty of an actual football game.

SUMMARY OF THE INVENTION

These and other objects are accomplished in accordance with the present invention which includes a game board with a simulated playing field which includes a recording element to keep track of the "yards to go" and another recording element to keep track of the down at any given point in the game. The recording elements are in the form of charts with numbers and movable arrow markers which can point to any of the numbers or are in the form of dials with numbers. A ball marker is positioned on the board to represent the line of scrimmage at any down or at the time of any other event during the game.

There are five decks of playing cards which are identified on one surface as to which deck each card is from. The other surface of each card contains an instruction which is usually the result of an individual play. The five decks include a down deck, a punt deck, a PAT ("point after touchdown") deck, a field goal try deck and a kick-off deck. In each deck the frequency of the number of cards with a particular instruction is arranged statistically in the form of a normal distribution such that the results that are most likely in any given play of a real game are represented with a greater frequency than the results are which are less likely, and at the same time a broad range of results is possible. For example, in the down deck there are eleven cards for running plays with a gain of two yards but only two cards for running plays with a gain of ten yards. The array of cards in each deck are arranged statistically to correspond to the frequency of results in a real game.

Once the offensive player is selected the game is begun by having the opposing player select the top card from the kick-off pile which determines the length of the kick and the run back, if any, and the ball marker is placed at the appropriate position on the board. The "yards to go" marker is placed at ten yards and it is first down. The offensive player then selects the top card from the down cards which determines whether there has been a gain or a loss or a penalty or some other event and play continues in a similar manner. After each play the number of downs remaining and the yards to go are determined and recorded on the appropriate recording device.

As long as the offensive player has possession of the ball under the usual rules of professional football he continues to draw one at a time the top card from whichever of the five decks he chooses to draw from. At some point he may elect to draw a punt card to determine the results of a punt or he may draw a field goal try card. If he scores a touchdown he will draw a PAT card and the scoring is determined in accordance with the rules of a real football game.

Once the first offensive player scores or loses possession of the football, the other player then becomes the offensive player. The offensive player in either case is the player which has the privilege of drawing or continuing to draw cards from the five decks available.

There is a half-time card which is inserted in approximately the middle of the deck of down cards at the beginning of the game and when the half-time card is drawn in the course of play the first half has ended once the offensive player draws one more card. At this point the second half begins; the player who is to be on the offensive at the start of the second half was determined at the beginning of the game. This player may be the one who had the ball (on the offensive) when the first half ended or it may not be. The player who lost the "flip of the coin" or "draw" at the beginning of the game has the ball first at the beginning of the second half.

Thus the number of cards remaining in the down pile instantly and continuously provides visual representation of the approximate number of plays remaining in the game. In the case of a tie the down pile is reshuffled, placed face down in its position on the board and the game is continued until one player has made a score of some kind which ends the game.

The board has five spaces on it labeled for each of the five decks and the decks are placed face down in the spaces in order to set the board up to play the game. The board also have five opposite spaces marked off in which the used cards from each deck are placed to avoid mixing cards out of their proper deck. The game may also be played for a fixed time period by reshuffling, if necessary, the cards in any deck which has been depleted.

The main characteristics of the game may be summarized as providing a simplified football game with ease in determining progress in which the height of the stack of down cards provides a visual cue to instantly and continually show when the game is nearing its end by the number of down cards remaining unplayed in the down deck. The game minimizes the complication of keeping track of time or counting cards or plays to determine the end of the half by use of a half-time card, simplifies the determination of the outcome of a play by means of single outcome indicia on each card which gives the result instantly without reference to other data or chance determining devices, and reduces the necessity to learn special game rules or to perform complicated matching of cards or charts to determine the outcome of plays.

DETAILED DESCRIPTION OF THE PREFERRED EMBODIMENT

In the description which follows, like parts are marked throughout the specification and drawings, respectively. The drawings are not necessarily to scale, and in some instances proportions may be exaggerated in order to more clearly depict certain features of the invention.

Figure 1:
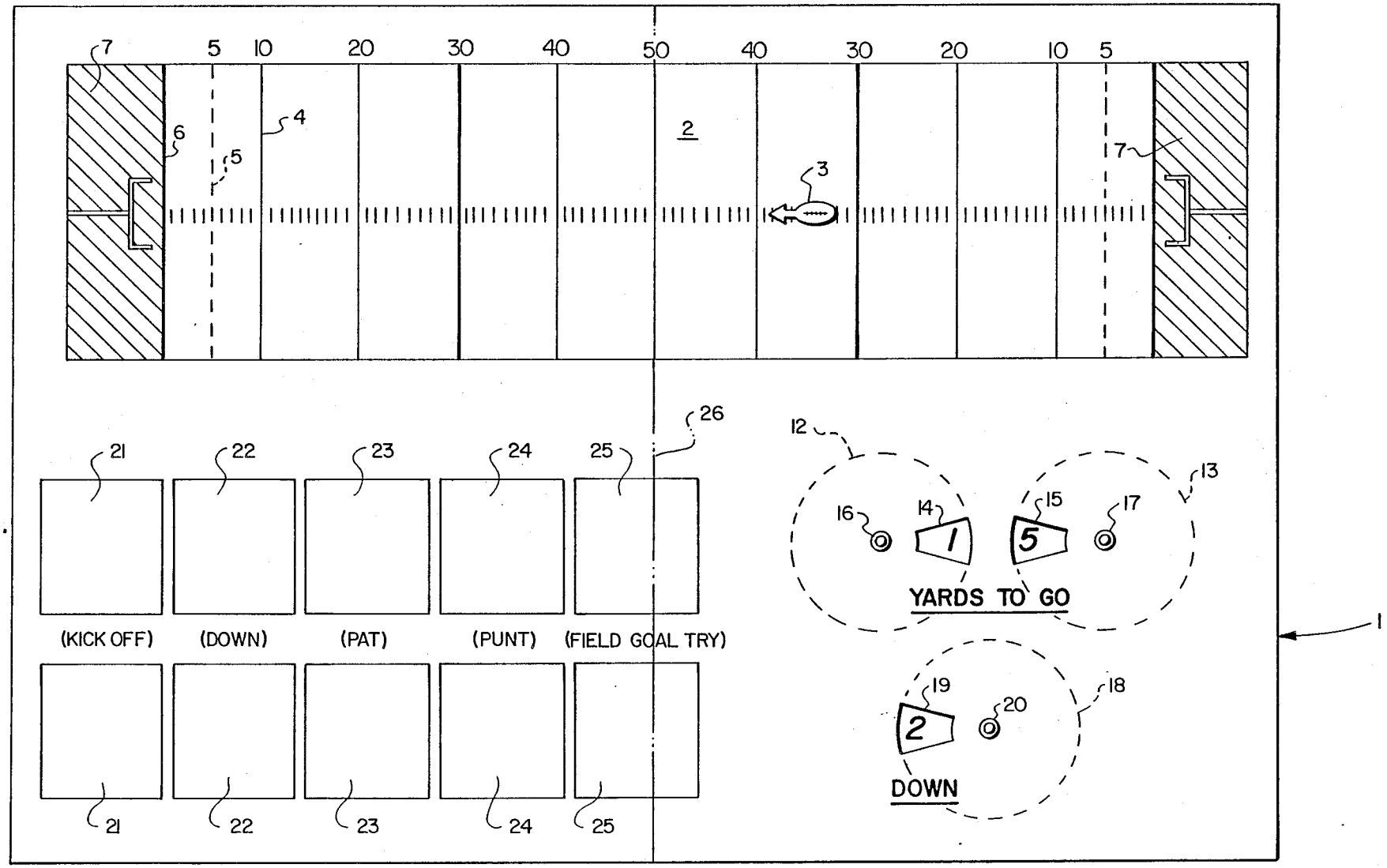
FIG. 1 shows the lay-out of the game-board with dialable indicators to record "yards to go" and downs.
Figure 2:
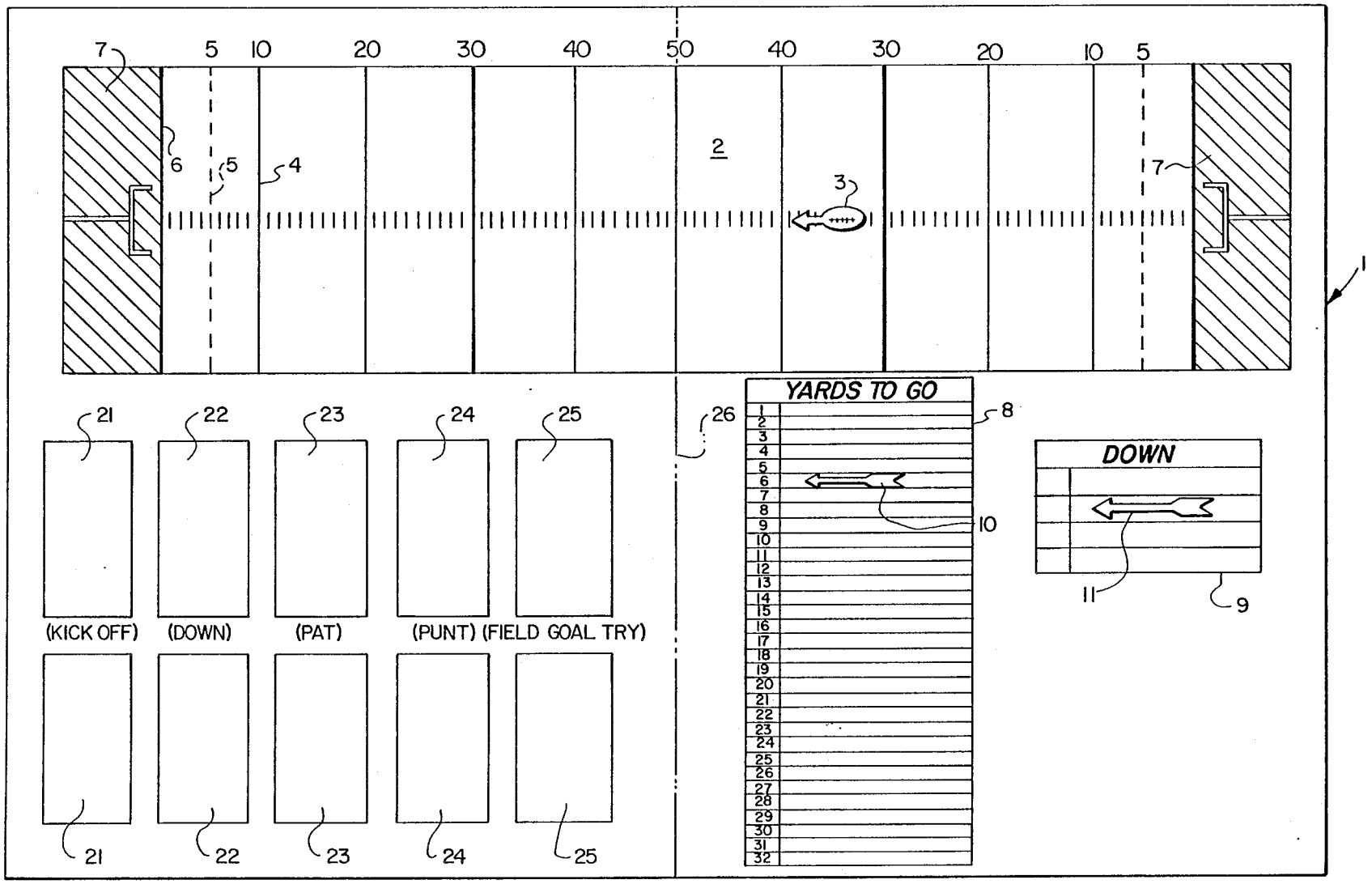
FIG. 2 shows the game-board with an alternative simple chart method of recording "yards to go" and downs.

The game is played with a "board" 1 in FIG. 1 and FIG. 2 which has a simulated playing field 2 marked off like a regular football field. Down the middle of the playing field 2 are 100 marks to indicate and simulate a 100 yard football field. The board is divided evenly by lines such as line 4 across the "field" to indicate 10, 20, 30, 40, and 50 yard stripes on each end. The five yard lines such as line 5 near each end of the field are indicated by a dashed line across the field.

Each end of the field has a goal line such as goal line 6 which represents the zero position of the yardage marker lines. End zones such as zone 7 at each end of the field represent the scoring zones as on a real field. The goal posts are represented at the end zones.

The game board also contains two columns of numbers. One is headed by the term "yards to go," and the other, is headed by the term "down." The "down" column is numbered 1, 2, 3 and 4 in order to indicate the correct down which is being played. The "yards to go" column is numbered from 1 to 32. This column of numbers allows for the showing of the number of yards needed for a "first down."

In FIG. 2 the "yards to go" column is represented by the reference numeral 8 and the down column is represented by the reference numeral 9. The "yards to go" column 8 also has therewith a yardage marker 10 which may be placed thereon to indicate the correct yards to go at any particular point in the game. The down column 9 likewise has a down pointer 11 which is used to point to the correct down. Each pointer is moved when necessary as the game dictates.

In FIG. 1 the "yards to go" is determined with reference to a pair of dials 12 and 13 which are mounted to the underside of the playing board. The board has windows so that numerals on the upper face of the dials can be seen. A window 14 is provided for dial 12 and a window 15 is provided for dial 13. Windows 14 and 15 are in effect specially shaped openings which are punched or cut completely through the board.

Dial 12 has a knob 16 and dial 13 likewise has a knob 17 which are attached through the board to the dials and mounted thereto such that rotation of the knobs 16 and 17 will effect rotation of the dials 12 and 13. Similarly there is provided a down indicator dial 18, a window 19 and a knob 20 just like those of the "yards to go" dials and it is mounted to and through the board so that rotation of the knob 20 will effect rotation of the dial 18 and the numbers on the face of the dial 18 will appear in the window 19.

It is most convenient to have the down dial 18 positioned below the "yards to go" dial as is shown in FIG. 1. The dial 18 has upon its surface the numerals 1 through 4 to represent the four downs that are possible in the game.

The face of the dials 12 and 13, which is the portion visible through the windows 14 and 15 respectively have thereon numerals which are spaced so as to be individually visible one by one as the dial is turned. The dial 13 contains the numerals 0 through 10 around its periphery and the dial 12 contains the numerals 0 through 9 around its periphery. The pair of dials 12 and 13 work together to show the total yardage that remains to a "first down."

The dials 12 and 13 are arranged with the windows 14 and 15 directly opposite each other as shown in FIG. 1 so they combine to show the yardage necessary to reach a "first down." In FIG. 1, for example, if it is second "down" and 15 yards to go for a first down, then the dial on the upper left will read "1" and the dial in the upper right will read "5." The "down" disk will read "2." Thus all dials together indicate the play is second down and 15 yards to go for a first down. If the yardage to be gained is ten yards or less, the dial 12 on the left is set at zero and only the dial 13 on the right is used.

The yardage and down recording elements are provided only to provide a convenient positive way of visually showing this game controlling information, but they are not necessary because players can keep track of this information mentally during play of the game.

Some players prefer to use the recording elements while other players prefer to avoid their use in the interest of simplicity and expediency.

The game board is also marked off with duplicate spaces for the five different decks of cards used to play the game. They include labels for kick-off 21, down 22, PAT 23, punt 24 and field goal try 25. One of the spaces would contain unplayed cards for the appropriate deck with the other space being utilized for cards that have already been played. The system should be uniformly applied so that it is clear that all the unused cards are in one row of spaces 21 through 25 and the used cards are in the other row of spaces 21 through 25.

Figure 3:
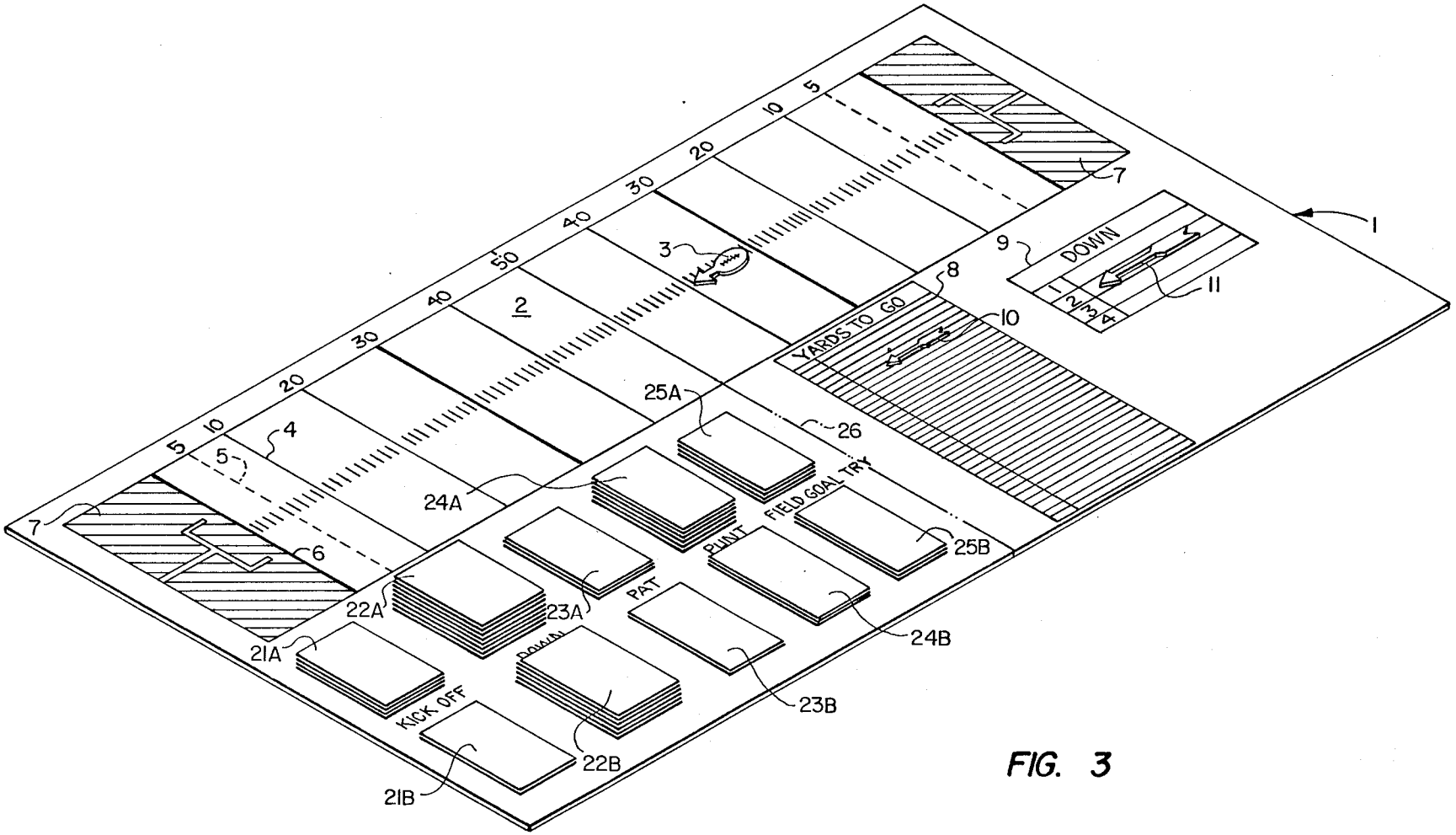
FIG. 3 is a perspective view of the game board arrangement shown in FIG. 2.

FIG. 3 is a perspective view of the board showing how the stacks of cards appear during progress of the game. They are numbered to correspond with the duplicate spaces 21 through 25. FIG. 3 shows unused or not yet used kickoff cards 21A, down cards 22A, PAT cards 23A, punt cards 24A and field goal cards 25A. The used cards from the respective decks of cards, cards which have been played are also shown in FIG. 3. These stacks of used cards are labeled kickoff cards 21B, down cards 22B, PAT cards 23B, punt cards 24B and field goal cards 25B. Each of the complete decks is made up of the used and the unused cards from that particular deck. The stack of unused down cards from the down deck adds a particularly significant feature to the play of the game. The amount of unplayed down cards remaining provides a convenient means for visually and instantly estimating during the game, the number of down plays remaining in the game, because the game is over when the players have gone through the down deck of cards one time. (Unless the players choose to use a period of time, for example, as the time for play of the game).

The game is played with five different sets of cards. These cards give directions and instructions as to each move on the game board. The cards are marked "kick-off," "punt," "field goal try," "PAT," (to indicate "point after touchdown"), and "down." These cards are like ordinary playing cards in that one surface has indicia giving the name of each cards, such as "kick-off," whereas the opposite surface of that same card had indicia containing a message or instructions which relate to a result of a play.

The cards are preferably rectangular in shape and uniform in size to facilitate shuffling prior to the beginning of a game. The cards from each set must not be mixed with the cards from any other set. What follows now is a summary of the instructions that appear on the surface of each card of every set of cards.

The information for the cards is arranged in a summarized fashion and the numbers which are not in parentheses refer to the yardages on the simulated playing field 2 of the board. The numbers that are in parentheses represent the number of cards in the group which have a specific result. Some of the cards have numbers which refer to a yard line on the simulated playing field. For example, in the "kick-off" set of cards the yardages on most of the cards refer to a yardage line at which the offensive player will begin his play.

In other cases such as the running plays in the "down" deck, the numbers not in parentheses will refer to the number of yards gained or lost. Negative numbers without parentheses refer to yards lost. As before the numbers in parentheses refer to the number of cards in the category which contain a particular message. This will become clear in going through the summary of instructions that appear on the cards.

I. The "Kick-off" Deck

The "Kick-off" deck contains 24 cards. One surface has "Kick-off" written on it while the other surface tells where the ball will be placed on the playing field. After any touchdown and PAT attempt, after start of second half, or after a field goal attempt, the team last in possession draws from the "kick-off" deck to determine the place of start for the team gaining possession.

A description and number of each "Kick-off" card is as follows:

a. On Side Kick
Good: Kicking team starts on 50 yard line (1)
Failed: Receiving team starts on 45 yard line of opponent (1)
b. Runback for Touchdown (1)
c. Start on Own:

| | |
|---|---|
| 10 (2) | 30 (2) |
| 15 (3) | 35 (2) |
| 20 (6) | 40 (1) |
| 25 (4) | 45 (1) |

II. The "Down" Deck

The "Down" deck contains 131 cards. Each card is marked to instruct the player how far and in what direction (forward or backward) to move the ball on the field.

A description and the number of the "Down" cards is as follows:

a. Running Plays

| Play | Number of Cards |
|---|---|
| −1 | (2) |
| −2 | (1) |
| 0 | (9) |
| 1 | (10) |
| 2 | (11) |
| 3 | (11) |
| 4 | (8) |
| 5 | (8) |
| 6 | (8) |
| 7 | (6) |
| 8 | (4) |
| 9 | (3) |
| 10 | (2) |

b. Touchdown Pass (2)
c. Pass Interception
20 yards from scrimmage line (2)
10 yards from scrimmage line (2)
Runs ball back 23 yards on offensive side (1)
d. Sack

| Play | Number of Cards |
|---|---|
| −5 | (4) |

e. Fumble
(4) Fumble
(1) Pass caught 40 yards ahead then fumbled
f. Defensive Penalty
Offside 5 (3)
Penalty 10 (2)
g. Offensive Penalty
−5 (5)
−5 & loss of down (pass beyond scrimmage line) (1)
−10 (2)
−15 (1)
h. Pass Plays
Dropped (2)
Incomplete (3)
Completed Pass Gain -continued

| |
|---|
| 0 (1) |
| 3 (2) |
| 8 (1) |
| 12 (1) |
| 15 (3) |
| 20 (2) |
| 22 (1) |
| 30 (1) |
| 35 (1) |

III. The "Punt" Deck

The "Punt" deck contains 38 cards. Of these cards, 3 are so-called "trick plays."

A description and the number of the "Punt" cards is as follows:

| | | | |
|---|---|---|---|
| Trick Play - 20 yard gain | (1) | 30 yards & a 5 yard return | (3) |
| Trick Play - 30 yard gain | (1) | 35 yards-no return | (7) |
| Fake - 30 yard gain | (1) | 40 yards & a 5 yard return | (6) |
| 15 yards & no return | (1) | 40 yards-no return | (6) |
| 20 yards & no return | (3) | 45 yards-no return | (1) |
| 30 yards & no return | (8) | | |

IV. The "Field Goal Try" Deck

The "Field Goal Try" deck has 25 cards. One of these is a fake try for a 10 yard pickup. Two cards assess 5 yard penalties on the defense. In the event of such a 5 yard penalty, the offensive player gets to draw another card from the down deck or the field goal deck.

A description and the number of the "Field Goal Try" cards is as follows:

| | |
|---|---|
| Good | (10) |
| Missed | (9) |
| Blocked | (3) |
| Off side 5 yard penalty | (2) |
| Fake - 10 yard gain | (1) |

V. The "PAT" Deck

The "PAT" (point after touchdown) deck contains 19 cards. Each determines if the point is "good" of "missed." This is to be drawn after each touchdown.

A description and the number of the "PAT" cards is as follows:

| | |
|---|---|
| Good | (14) |
| Blocked | (3) |
| Miss | (2) |

VI. Half-time Card—one (1)

This card is to be placed approximately in the middle of the cards marked "down," after the deck is shuffled and play is about to begin. When this card is drawn, the one drawing the card may then have only one more play. If he is inside the opponent's 50 yard line, he has the option to try for a field goal or to draw only one more card from the "down" set. No field goal may be attempted beyond 50 yards. The ball then goes over to the player who lost the coin flip at the start of the game. The other player draws from the "kick-off" cards to determine where his opponent starts the second half of play. When the "Half-time" card is drawn, it is set aside so it will not become mixed with the "down" cards again.

The play of the game will now be described. The regular and current roles of professional football are to be used as rules of the game, except as otherwise stated. To determine who the first offensive player is, a coin may be flipped or players may draw from the "down" pile. The player drawing the best yardage gain on the draw of the card from the down pile becomes the first offensive player.

After it is determined who is to be the offensive team, the other player draws a "kick-off" card to determine where on the field the opposing player will begin. If an "on side kick" card is drawn, it is replaced in the deck, the cards shuffled and the player draws again. Then the offensive team draws his first "down" card and moves forward, backward, or stays where he is according to the instructions on the "down" card he draws.

The down deck contains cards which have on one side indicia which specify the outcome of a kind of play situation which occurs in an actual game once a team has possession of the ball and prior to the time they score. The down deck contains all the typical outcomes of running or passing plays from scrimmage. Punts and field goals are treated separately by selecting cards from the "punt" or "field goal" decks.

When a card is selected from the down deck it will fall within a group of cards denominating a kind of play as opposed to the type of play situation that exists at any point in the game. A type of play situation, for example, would be the decision to punt or to try a field goal; choices which are optional with the offensive team. A type of play situation is one controlled by the previous events in the game or by the clock, such as a kick-off or a point after touchdown. The type of play situation is represented by the five decks and corresponds to common label or name for cards from a deck. A type of play or play situation is defined herein and distinguished from a kind of play or play situation, as a choice made by the player with the right to draw a card, to draw from one of the five decks of cards. In some cases that choice is optional and in other cases it is determined by a previous event. A kind of play or play situation is a card from a group of one or more cards within one of the decks of cards. The kind of play or play situation is denominated by the indicia on a particular card from a group of one or more cards in a deck. The player does not choose the kind of play or play situation for that is specified along with the outcome once the player choses a card from a given deck.

The down deck contains separate groups for running plays, pass plays, pass interceptions, defensive and offensive penalties, sacks of the quaterback and fumbles. Except for the half-time card which will be described later, any card selected from the down deck will denominate the outcome of a play from one of those groups.

In addition to determining the kind of play that has taken place, the cards show the number of yards gained or lost by means of positive or negative numbers which represent yardage. A zero indicates that no gain or loss has taken place on the play.

The number of cards in each group varies substantially according to the group which the card represents. For example, there are 18 cards in the group for pass plays but only two cards in a separate group for touchdown passes. The group of running plays contains 83 cards.

It is important that the numbers of cards in each group be statistically related to the approximate frequency of a particular kind of play in an actual game, for this adds interest and realism to the game.

In addition to the statistical frequency distribution of the number of cards in each group, there is also a statistical frequency distribution of the typical outcomes from running a play or incurring an event within each group. This is best illustrated by examining the group containing running plays where the cards denominating zero, one, two or three yard gains total 41 cards out of the 83 cards in the group. Only two cards represent a ten yard gain. Thus the cards are carefully distributed to represent outcomes that are typically and representative of the outcome of the happenings in any group which would be observed in an actual game. Some of the groups which represent the kind of play result that is infrequent will have only a few cards, such as the group containing touchdown passes.

The frequency of outcomes both among and between groups is calculated to produce typical and interesting game results. Yet the system is simplified because both the kind of play and the outcome are quickly and easily determined simply by drawing a card. This makes the game particularly suitable for use by young children or people who do not wish to engage in complicated tactical choices and intricate manipulations in order to determine the outcome.

Still some tactical choice for the offensive player remains in the game because a player still has the choice of trying for a first down, punt or a try for a field goal. These choices can easily be made by young children and they add considerable interest and a small degree of skill to the game.

Any question as to the place of the ball is determined by the current rules of professional football. For example, if the ball is inside the opponent's ten yard line, a penalty as called for by the "down" card cannot exceed one-half the distance to the goal line. Another rule is that the offensive player cannot be "penalized" back into his own end zone. For example, if the ball is on the five yard line, the player cannot be penalized back more than one-half the distance to the goal line.

However, a loss of yardage into the end zone on a fair play (a play without a penalty, such as a sack of minus five yards) is considered a "touch back." The defensive team gets two points and then the team which gave up the score draws from the "punt" cards to determine where the other player gets the ball to begin his offensive series of plays. This punt is delivered from the 20 yard line. If a "trick play" card is drawn at this point, it is placed back in the deck and the deck is shuffled. Another card is then drawn to determine the starting position of the offensive team.

An exception to professional football rules is on the field goal try. No player may draw from the "field goal" deck if his position on the board is further than 30 yards away from the goal line. There is an exception to this distance requirement in the case of the "half-time" card where a 50 yard limit applies to the option to try a field goal.

If a player fails to gain a new series of downs by fourth down by advancing ten yards from his starting position, he may choose to "punt" by drawing from the "punt" pile to give the ball over to the other team, or he may draw again from the "down" pile in an attempt to gain a first down. The choice and result will then determine the place where the opposing team will start. If the punt card is a "trick play" and the player gains a first down, he retains his turn and continues to draw from the "down" deck. If a punt goes into the end zone, the opposing player starts on the 20 yard line.

The game cannot end if the last "down" card is a penalty on the defensive team. In such a case, the cards are shuffled and the offensive team gets to draw one more "down" card to determine the final position of the ball.

The ball may be spotted between the yardage markers. For example, the ball may be placed at the 2½ yard line, the 3½ yard line, etc., as a penalty may call for. The players may simplify the difficulty related to the use of fractions by operating with a rule that uniformly places the ball at a uniform integer away from the goal line in such cases.

The position of the ball on the simulated playing field is indicated by the use of a ball marker which is moved from place to place along the individual yard markers in the center of the field. The yardage marker should have a pointed and/or narrow end to indicate the direction of movement. The ball marker will be reversed depending on which direction the player selecting cards is moving.

The end of the first half is determined by the use of the half-time card which was previously described. It adds interest to the game because the players, although knowing that it will be in approximately the middle of the "down" deck, nevertheless do not know exactly when it will appear. This adds excitement particularly when the player is close to a touchdown and knows that he has only one more card once the half-time card appears.

The game is over when the players go through the "down" deck of cards one time. The game can be timed to play for a given number of minutes by the clock, such as 30 minutes, 45 minutes, etc., but it is preferable to use the "down" deck as the ending point. This also adds interest as the "down" deck instantly and visually gives a cue to the players that the game is winding down and not much time remains. This adds interest just as the clock in a real game does, particularly when the game is close and the opposition is approaching the goal line. The players do not have to divert their attention from the game or refer to clocks or timers to achieve this knowledge since the diminishing pile is a constant reminder.

In the case of a tie, once the "down" deck has been exhausted or at a pre-determined length of time, the cards are reshuffled and the game resumed. Both players draw as in the beginning and the one with the best yardage gain gets the ball first. The other player draws from the "kick-off" pile to determine the position of the ball. The first player to score is the winner.

The scoring is in accordance with the usual football scoring rules. A touchdown is six points, a point after touchdown is one point, a field goal is three points and a touch back is two points. The score of six points is acquired when the ball crosses or touches the goal line. If the ball is on the five yard line and the down card is a nine, this is a touchdown. If the card drawn is a five and the ball is on the five yard line, this is a score also. After a touchdown is scored, the team scoring draws from the "PAT" deck to determine if his point after touchdown is good.

After the point after touchdown attempt, the scoring team draws from the "kick-off" deck to determine the starting place of the other player. If the card is a good "onside kick," the scoring team retains the ball and the right to continue drawing cards.

It is desirable to have the game board be of sufficient size so that the one yard indications on the simulated playing field are separated by a sufficient space to allow the yards to be counted in a gain or loss on a play and to minimize uncertainty about the position of the ball marker. Therefore a large game board is desirable and is preferably made as two halves and joined together at a fold line 26 by a flexible tape material to make shipping and handling more convenient. It is suggested that the decks of cards be approximately the size of an ordinary playing card deck and of similar construction.

Although a preferred embodiment of the invention has been described in detail, it should be understood that various substitutes, alterations and modifications may become apparent to those skilled in the art. These modifications can be made without departing from the spirit and scope of the invention as defined in the appended claims.

I claim:

1. A method for playing a game of football on a playing board having a simulated playing field with yardage markings, a moveable ball marker with directional arrow for indicating the position and advancement of the ball, and at least five card decks including a kickoff deck, a down deck, a punt deck, a point after touchdown deck, and a field goal, wherein each deck includes a variety of cards representing a range of play outcomes, with each card having a play situation category indicia on one side surface and a single play outcome indicia on the opposite side surface, said method comprising the steps of:

drawing a card from a selected play situation deck and placing it adjacent the selected deck in side-by-side relation therewith thereby defining an active deck and a used deck pair for each of the deck categories, whereby the relative stack heights of the adjacent active and used decks in each category pair can be quickly and easily inspected and compared during play by either player;

moving the ball marker to a position on the simulated playing field according to the play outcome indicia of the drawn card;

selecting a play situation deck from which the next card is to be drawn based upon the location of the moveable ball marker and a visual comparison of the respective stack heights of the cards in the active deck and the cards in the used deck of each play category, said relative stack heights of an adjacent active and used deck pair indicating the likelihood of selecting a specific play outcome from the remaining cards in each of the category active decks, while visually indicating an estimatable relative percentage of the game completed by comparing the stack heights of the active "down" deck to the adjacent used "down" deck; and, drawing a card from one of the five play category active decks and placing it adjacent to the active deck in side-by-side relation therewith, thereby defining an active deck and used deck pair for the selected play category and advancing the moveable ball marker in correspondence to each offensive play and play outcome indicia until all the cards in the active "down" deck are exhausted.

2. A method for simulating the game of football on a playing board having a simulated playing field and yardage markings, a "down" and "yards-to-go" indicator, a moveable ball marker with directional arrow for indicating the position and advancement of the ball, and five card decks: a kickoff deck, a down deck, a punt deck, a point after touchdown deck, and a field goal deck corresponding to five different types of play situations, including the steps of:

drawing a card from one of the five active decks corresponding to the play situation required;

reading the play outcome indicia on one surface of the selected card having a play situation indicia on the opposite surface, wherein each deck contains multiple cards, and each card having a single outcome, said "down" deck having run, pass, touchdown pass, pass intercept, sack, offensive penalty, defensive penalty, or fumble play outcome cards; said "kick-off" deck having on-side kick, run-back for touchdown, or starting at various yard lines play outcome cards; said field goal deck having offside penalty, fake, missed, good, or blocked field goal play outcome cards; said point after touchdown deck having good, blocked, or missed kick play outcome cards; said punt deck having trick play, fake or yardage gained with or without run-back play outcome cards;

placing the drawn card face down onto the playing board adjacent to the selected active deck and in side-by-side relation therewith, thereby defining an active deck/used deck pair for the selected play category, and visually comparing the respective stack heights of the active and used decks;

moving the ball marker in response to the outcome shown on the selected play outcome card, said play outcome being limited to the specific card chosen from the corresponding play situation deck, whereby the player drawing from the "down" deck having no choice between receiving either a running or passing play when making the offensive "down" card selection; and, repeating the above sequential steps until all the cards in the active "down" stack are drawn or exhausted, thereby ending the game.

* * * * *